US005415286A

United States Patent [19]

Marchek et al.

[11] Patent Number: 5,415,286

[45] Date of Patent: May 16, 1995

[54] PACKAGING CONTAINER FOR FLAT FLEXIBLE CIRCUITS

[75] Inventors: Kyle J. Marchek, Lisle; Timothy R. McClelland, Bolingbrook, both of Ill.

[73] Assignee: Molex Incorporated, Lisle, Ill.

[21] Appl. No.: 238,295

[22] Filed: May 5, 1994

[51] Int. Cl.[6] ..... B65D 85/38

[52] U.S. Cl. ..... 206/330; 206/334; 206/394; 206/599

[58] Field of Search ..... 206/328-334, 206/391-397, 446, 587, 591, 594, 386, 597, 599; 108/55.1

[56] References Cited

U.S. PATENT DOCUMENTS

| | | | |
|---|---|---|---|
| 3,088,619 | 5/1963 | Boucher | 108/55.1 |
| 3,332,546 | 7/1967 | De George | 206/395 |
| 3,859,511 | 6/1971 | Britt . | |
| 4,027,794 | 6/1977 | Olson | 206/386 |
| 4,151,914 | 5/1979 | Blatt | 206/395 |
| 4,832,196 | 5/1989 | Butler | 206/391 |
| 4,901,870 | 2/1990 | Wright et al. | 206/446 |
| 5,131,535 | 7/1992 | O'Connor et al. | 206/329 |
| 5,193,680 | 3/1993 | Schumann et al. | 206/394 |
| 5,209,352 | 5/1993 | Light et al. | 206/391 |

FOREIGN PATENT DOCUMENTS

| | | | |
|---|---|---|---|
| 3310811 | 9/1984 | Germany | 206/386 |

OTHER PUBLICATIONS

Menasha Corporation Brochure, "Convoy Opte-Pack" Form 5/93-OPTE.

*Primary Examiner*—Jimmy G. Foster
*Attorney, Agent, or Firm*—A. A. Tirva

[57] ABSTRACT

A packaging container is provided for flat flexible electrical circuits that are wound about individual cores, with opposite ends of the cores projecting axially beyond the wound circuits. Top and bottom pallets each are provided with shock-absorbing interior walls for engaging the opposite ends of the cores to mount the wound circuits between the pallets without engaging the circuits. A peripheral side wall structure is latched between the pallets spaced from and substantially enclosing the mounted circuits therewithin.

14 Claims, 3 Drawing Sheets

PACKAGING CONTAINER FOR FLAT FLEXIBLE CIRCUITS

FIELD OF THE INVENTION

This invention generally relates to packaging systems and, particularly, to a packaging container for flat flexible electrical circuits.

BACKGROUND OF THE INVENTION

There are a wide variety of packaging systems, including containers, for protecting various electrical devices during storing, shipping or other handling or transit. Some of the most difficult electrical devices to package and protect are flat flexible electrical circuits. Such circuits often are wound in predetermined lengths on individual cylindrical cores. Each individual core/circuit assembly is wrapped in resilient packaging material. The assembly then in placed into an individual container and, finally, a number of individual containers are assembled into a large shipping container. It can be understood that this system of packaging is very labor intensive, time consuming and, consequently, quite expensive. Unpacking of the core/circuit assemblies presents similar problems in reverse.

The present invention is directed to solving these problems by providing a packaging container assembly which includes a structural arrangement for handling and storing flat flexible circuits wound on individual cores in a very simple design. The flexible circuits are protected from direct external pressures as well as against pressures exerted by internal packaging materials or any other forces.

SUMMARY OF THE INVENTION

An object, therefore, of the invention is to provide a new and improved packaging container for flat flexible electrical circuits that are wound about individual cores, and particularly with opposite ends of the cores projecting outwardly beyond the wound circuits.

In the exemplary embodiment of the invention, the container includes top and bottom pallets each having shock-absorbing mounting means for engaging the opposite ends of the cores to mount the wound circuits between the pallets without engaging the circuits. Peripheral side wall means are provided between the pallets spaced from and substantially enclosing the mounted circuits therewithin. Basically, the core/circuit assemblies are mounted solely by the cores (i.e. the projecting opposite ends of the cores), and the circuits, themselves, are supported in air.

As disclosed herein, the top and bottom pallets are substantially mirror images of each other. The shock-absorbing mounting means on the top and bottom pallets are substantial mirror images of each other. The shock-absorbing mounting means are provided by at least a pair of internal, generally parallel walls having recesses for receiving the opposite ends of the cores. The walls are fabricated of rigid foam material.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
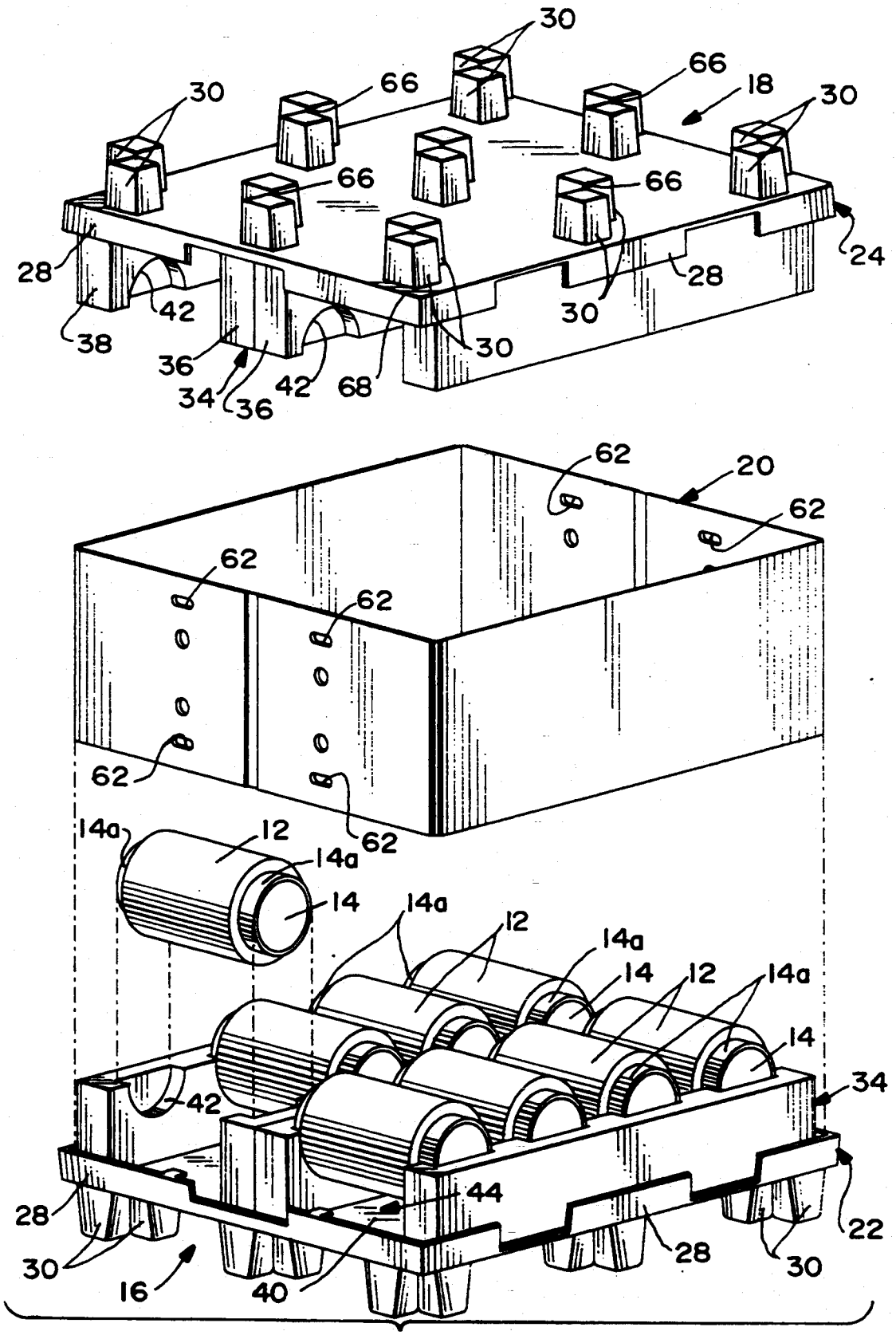
FIG. 1 is a perspective view of the packaging container of the invention, in disassembled condition.

Referring to the drawings in greater detail, the invention is directed to a packaging container, generally designated 10, for packaging flat flexible circuits 12 that are wound about individual cores 14. It can be seen that opposite ends **14*a*** of the cores project outwardly beyond the wound circuits.

Generally, container 10 includes a base assembly, generally designated 16; a cover assembly, generally designated 18; and a side wall structure, generally designated 20. Base assembly 16, in turn, includes a bottom pallet, generally designated 22, and cover assembly 18 includes a top pallet, generally designated 24.

At this point, it should be noted that base and cover assemblies 16 and 18, respectively, which include bottom and top pallets 22 and 24, respectively, are mirror images of each other. Therefore, only the base assembly and the bottom pallet will be described below with like reference numerals being applied in the drawings to the cover assembly and the top pallet.

Figure 2:
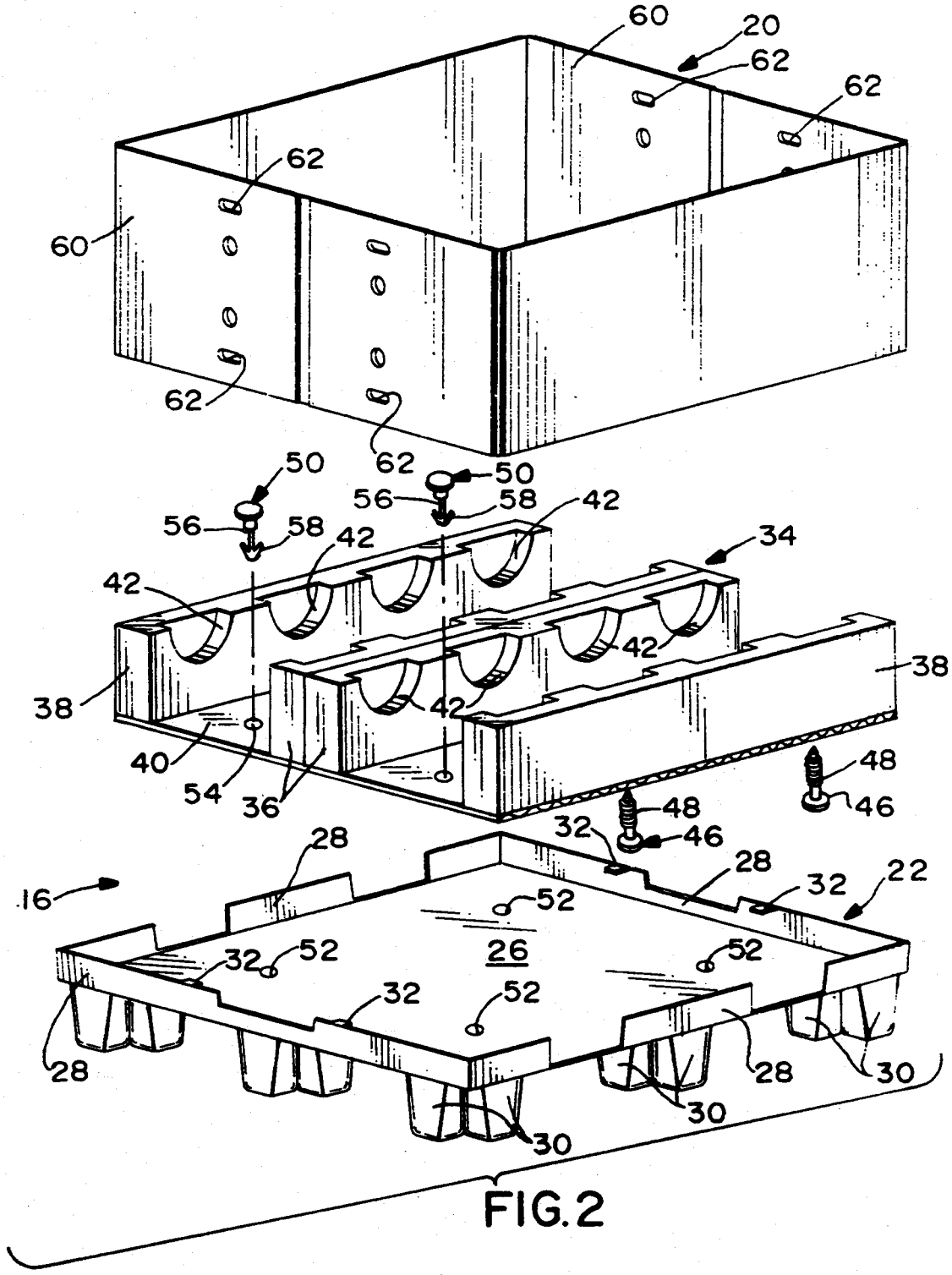
FIG. 2 is an exploded perspective view of the base assembly and the side wall structure of the container.

More particularly, referring to FIG. 2 in conjunction with FIG. 1, bottom pallet 22 of base assembly 16 includes a planar wall 26 with peripheral upstanding flanges 28 on one side thereof and pairs of feet 30 on the other side thereof. The planar wall is generally rectangular or square, with flanges 28 at the four peripheral edges thereof. For purposes to be described hereinafter, a pair of the opposite flanges include inwardly directed latch tabs 32.

As best seen in FIG. 2, an interior wall structure, generally designated 34, is mounted on planar wall 26 within flanges 28 of bottom pallet 22. More particularly, at least a pair of internal walls, including an inside wall 36 and an outside wall 38 are mounted on a planar substrate 40. Actually, there are two pairs of inside and outside walls 36 and 38 in a parallel array, with the inside walls being in a back-to-back juxtaposition as shown in FIG. 2. The facing or opposing faces of each pair of walls 36 and 38 are provided with semi-circular recesses 42 for receiving the opposite projecting ends **14*a* of cores 14 as shown in FIG. 1. The recesses are spaced from planar substrate 40 a sufficient distance so that flat flexible circuits 12 wound on the cores are spaced from the substrate, as indicated by an open area 44 in FIG. 1 beneath the supported core/circuit assemblies. Therefore, the assemblies, themselves, are mounted within container 10 surrounded by air, with the opposite ends 14*a* of cores 14 being the only portions of the core/circuit assemblies that are engaged by any portions of the container. Inside and outside walls 36 and 38, respectively, of wall structure 34 are fabricated of shock-absorbing material, such as an expanded cellular polystyrene that commonly is called a "rigid" foam (e.g. STYROFOAM of Dow Chemical Co.). Planar substrate 40 of interior wall structure 34 is fabricated of a shock-absorbing construction, such as a corrugated or plastic corrugated construction as seen in FIG. 2**.

In assembly of interior wall structure 34, inside and outside walls 36 and 38, respectively, are mounted to planar substrate 40 by means of a plurality of fasteners, generally designated 46. An adhesive such as hot melt glue may also be used in place of fasteners or in addition to the fasteners. Each fastener includes a shank portion 48 having a plurality of ridges or rings thereabout. The fasteners are inserted through appropriate holes in planar substrate 40, and the ridged shanks 48 are forced into the foam material of walls 36 and 38 to bite into the foam material and rigidly secure the walls and the substrate together. In addition, appropriate fasteners, generally designated 50, are inserted through holes 54 in planar substrate 40 of interior wall structure 34 and into holes 52 in planar wall 26 of pallet 22 to secure the interior wall structure to planar wall 26 of the pallet within flanges 28 of the pallet. Fasteners 50 are conventional "winged" configurations having shanks 56 with integral resilient wings 58 that snap outwardly into engagement with planar wall 26 about holes 52.

Figure 3:
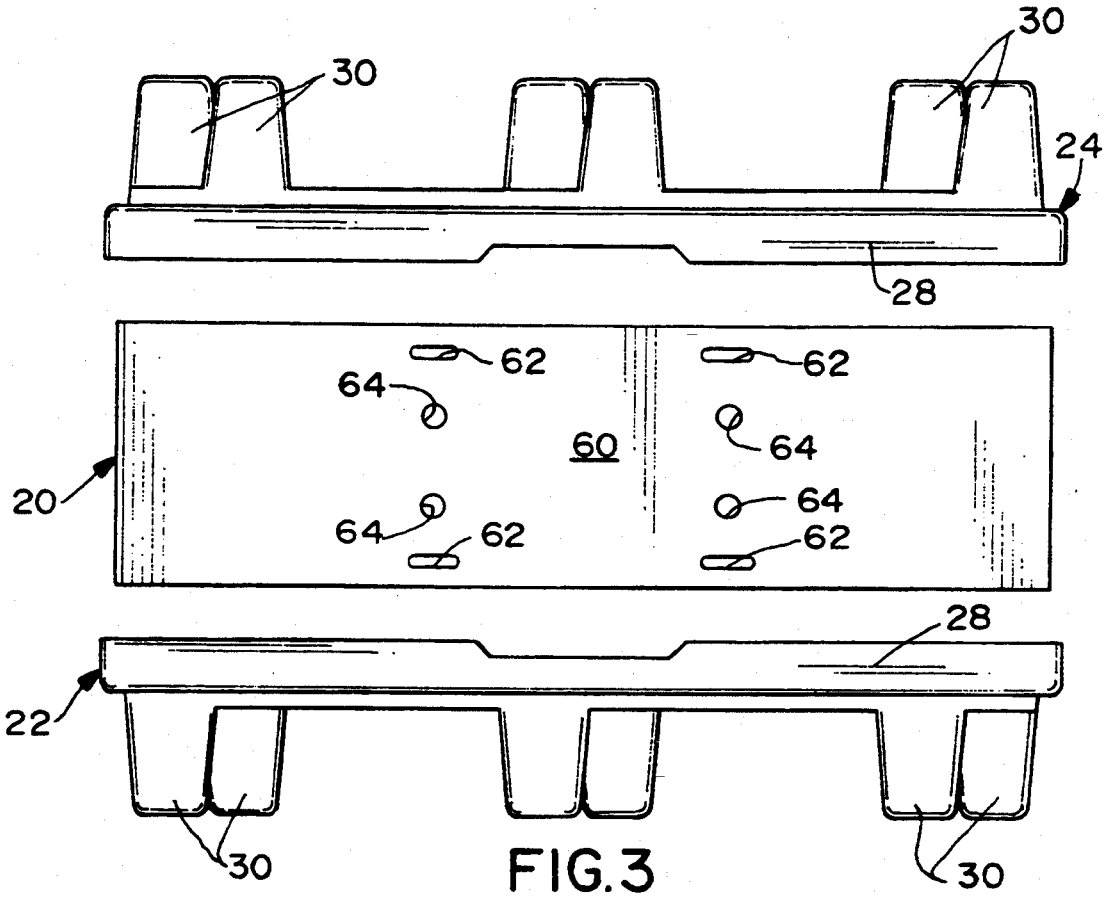
FIG. 3 is a side elevational view of the container in disassembled condition, with the interior wall structure removed to facilitate the illustration.
Figure 4:
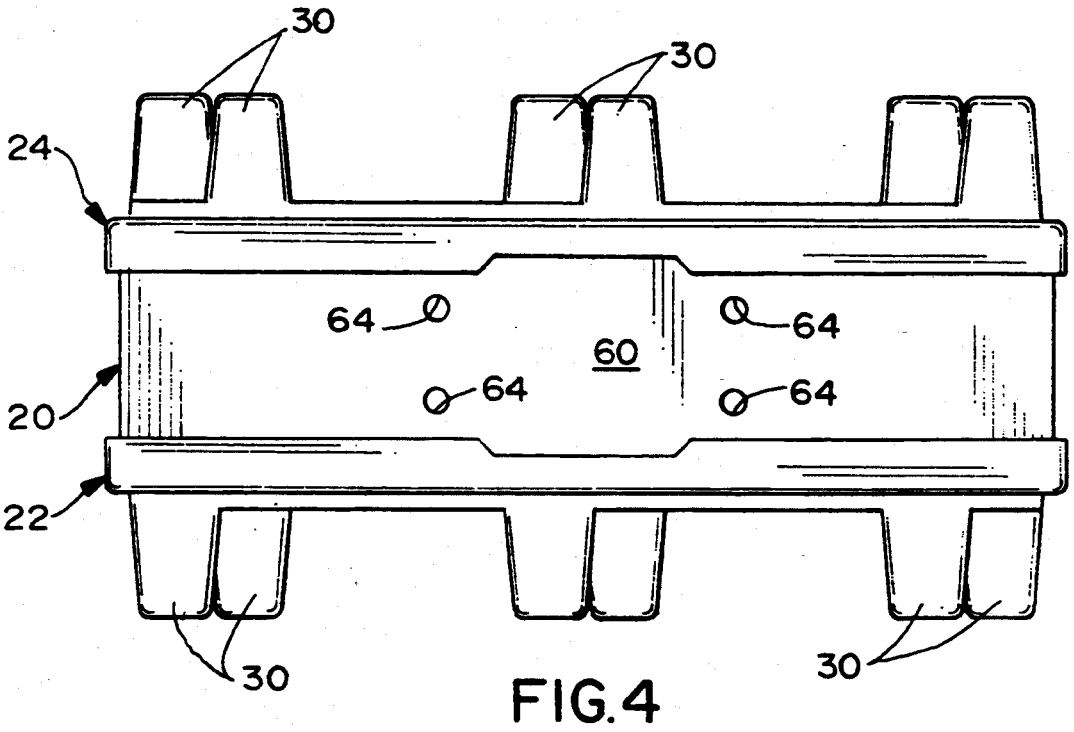
FIG. 4 is a side elevational view of the container in assembled condition.

In assembly of container 10, side wall structure 20 is positioned between base assembly 16 and cover assembly 18 as shown in FIG. 3. The interior wall structures 34 (FIG. 2) of the base and cover assemblies have been omitted from FIG. 3 to facilitate the illustration. Opposite side walls 60 of side wall structure 20 are provided with latch apertures 62 which snap into latching engagement with latch tabs 32 (FIG. 2) on the inside of flanges 28 of the bottom and top pallets. FIG. 4 shows the container in fully assembled condition, with side wall structure 20 in its latched condition between the base and cover assemblies 16 and 18, respectively. The side walls 60 also are provided with finger holes 64 for use by an individual in manipulating side wall structure 20, such as during assembly.

Lastly, although of a known construction, container 10 is stackable with other like containers by means of feet 30. Referring back to FIG. 1, it can be seen that all of the feet are arranged in pairs with slight spacings 66 between the feet in each pair. It also can be seen by the feet projecting upwardly from top pallet 24 of cover assembly 18 in FIG. 1, that the feet in all of the pairs are similarly oriented, which results in one foot being located at each of two opposite corners of the pallet, and a space 68 being located at the other two opposite corners. Therefore, when one pallet is inverted, such as, for example, pallet 22, such that it becomes pallet 24, the feet on pallet 24 are the mirror image of feet on pallet 22 allowing the containers 10 to be stacked. The corner feet of one container fit into the corner spaces of the other container, and, correspondingly, all of the pairs of feet interlock throughout the array thereof to allow stacking of the containers, with the feet preventing relative lateral movement between the containers. It also can be understood that the entire container structure 10 of the invention is readily reusable.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A packaging container for flat flexible electrical circuits that are wound about individual cores, with opposite ends of the cores projecting outwardly beyond the wound circuits, comprising:

top and bottom pallets each having shock-absorbing mounting means for engaging the opposite ends of the cores to mount the wound circuits between the pallets without engaging the circuits; and side wall means between the pallets spaced from and substantially enclosing the mounted circuits therewithin.

2. The packaging container of claim 1 wherein said top and bottom pallets are substantial mirror images of each other.

3. The packaging container of claim 1 wherein said shock-absorbing mounting means on the top and bottom pallets are substantially mirror images of each other.

4. The packaging container of claim 1 wherein said shock-absorbing mounting means comprise at least a pair of internal generally parallel walls having recesses for receiving the opposite ends of the cores.

5. The packaging container of claim 1 wherein said shock-absorbing means are fabricated of rigid foam material.

6. The packaging container of claim 5 wherein said shock-absorbing mounting means comprise at least a pair of internal generally parallel walls having recesses for receiving the opposite ends of the cores.

7. The packaging container of claim 5 wherein said shock-absorbing means are mounted on a generally planar substrate by means of fasteners having ridged shanks extending through the substrate and biting into the rigid foam material.

8. The packaging container of claim 7 wherein said substrate is a plastic corrugated structure.

9. A packaging container for flat flexible electrical circuits that are wound about individual cores, with opposite ends of the cores projecting outwardly beyond the wound circuits, comprising:

a base assembly having a supporting wall structure;

a cover assembly having a supporting wall structure of the base assembly, wherein said facing wall structures are fabricated of shock-absorbing material which comprises a rigid foam material;

complementary interengaging mounting means on the facing wall structures, for engaging the opposite ends of the cores to mount the wound circuits between the base and cover assemblies without engaging the circuit; and wherein said wall structures include parallel walls mounted on a generally planar substrate by means of fasteners having rigid shanks extending through the substrate and biting into the rigid foam material.

10. The packaging container of claim 9, including side wall means between the base and cover assemblies spaced from and substantially enclosing the mounted circuits therewithin.

11. The packaging container of claim 9 wherein said base and cover assemblies are substantial mirror images of each other.

12. The packaging container of claim 9 wherein said substrate is a plastic corrugated structure.

13. The packaging container of claim 9 wherein an adhesive means is located between said parallel walls on said planar substrate.

14. The packaging container of claim 13 wherein said adhesive means is a hot melt glue.

* * * * *